United States Patent [19]

Fujimura et al.

[11] Patent Number: 4,840,684

[45] **Date of Patent: * Jun. 20, 1989**

[54] ISOTROPIC PERMANENT MAGNETS AND PROCESS FOR PRODUCING SAME

[75] Inventors: Setsuo Fujimura, Kyoto; Masato Sagawa, Nagaokakyo; Yutaka Matsuura, Ibaraki, all of Japan

[73] Assignee: Sumitomo Special Metals Co, Ltd., Osaka, Japan

[ * ] Notice: The portion of the term of this patent subsequent to Jul. 22, 2003 has been disclaimed.

[21] Appl. No.: 567,640

[22] Filed: Dec. 30, 1983

[30] Foreign Application Priority Data

May 6, 1983 [JP] Japan ..... 58-79096
May 6, 1983 [JP] Japan ..... 58-79098
May 31, 1983 [JP] Japan ..... 58-94876

[51] Int. Cl.[4] ..... H01F 1/04

[52] U.S. Cl. ..... 148/302; 420/83; 420/121; 75/244; 75/245; 75/246

[58] Field of Search ..... 148/31.57, 302; 75/123 E, 123 B, 244, 245, 246; 420/83, 121

[56] References Cited

U.S. PATENT DOCUMENTS

| | | | |
|---|---|---|---|
| 2,167,240 | 7/1939 | Hensel . | |
| 3,560,200 | 2/1971 | Nesbitt et al. . | |
| 3,684,593 | 8/1972 | Benz et al. . | |
| 4,063,970 | 12/1977 | Steingrover . | |
| 4,401,482 | 8/1983 | Green et al. . | |
| 4,402,770 | 9/1983 | Koon | 148/31.57 |
| 4,533,408 | 8/1985 | Koon . | |

FOREIGN PATENT DOCUMENTS

| | | |
|---|---|---|
| 0106948 | 5/1984 | European Pat. Off. . |
| 54-76419 | 6/1979 | Japan . |
| 55-132004 | 10/1980 | Japan . |
| 56-65954 | 6/1981 | Japan . |
| 57-141901 | 9/1982 | Japan . |
| 58-123853 | 7/1983 | Japan . |
| 0126179 | 11/1984 | European Pat. Off. . |
| 0046075 | 2/1982 | European Pat. Off. . |
| 833049091 | 5/1984 | United Kingdom . |
| 2100286 | 12/1982 | United Kingdom . |
| 2021147 | 11/1979 | United Kingdom . |
| 56-29639 | 3/1981 | Japan . |
| 56-116844 | 9/1981 | Japan . |
| 57-141901 | 9/1982 | Japan . |
| 50-1397 | 1/1975 | Japan . |
| 55-115304 | 9/1980 | Japan . |
| 734597 | 8/1955 | United Kingdom . |
| 52-50598 | 4/1977 | Japan . |
| 53-28018 | 3/1978 | Japan . |
| 51-13304 | 9/1980 | Japan . |
| 56-47542 | 4/1981 | Japan . |
| 56-47538 | 4/1981 | Japan . |
| 58-123853 | 6/1983 | Japan . |

OTHER PUBLICATIONS

Hadjipanasyis et al, "New Iron-Rare-Earth Based Permanent Magnet Materials", Appl. Phy. Lett. 43(8), Oct. 15, 1983, pp. 797-799.

El Masry et al, "Phase Equilibria in the Co-Sm-B System", Journal of the Less-Common Metals, vol. 96, Jan., 1984, pp. 165-170.

Robinson, "Powerful New Magnet Material Found", Science, vol. 233, Mar. 2, 1984, pp. 920-922.

Stadelmaier et al, "Cobalt-Free and Samariun-Free Permanent Magnet Materials Based on Iron-Rare Earth Boride," Materials Letters, vol. 2, No. 2, Oct. 1983, pp. 169-172.

(List continued on next page.)

*Primary Examiner*—John P. Sheehan

*Attorney, Agent, or Firm*—Burns, Doane, Swecker & Mathis

[57] ABSTRACT

Isotropic permanent magnet formed of a sintered body having a mean crystal grain size of 1-160 microns and a major phase of tetragonal system comprising, in atomic percent, 10-25% of R wherein R represents at least one of rare-earth elements including Y, 3-23% of B and the balance being Fe. As additional elements M, Al, Ti, V, Cr, Mn, Zv, Hf, Nb, Ta, Mo, Ge, Sb, Sn, Bi, Ni or W may be incorporated.

The magnets can be produced through a powder metallurgical process resulting in high magnetic properties, e.g., up to 7 MGOe or higher energy product.

13 Claims, 9 Drawing Sheets

OTHER PUBLICATIONS

Givord et al, "Magnetic Properties and Crystal Structure of $Nd_2Fe_{14}B$", Solid State Comm., vol. 50, No. 6, Feb., 1984, pp. 497–499.
Nagel et al., "Influence of Cu-Content on the Hard Magnetic Properties of Sm(co,Cu) 2:17 Compounds", IEEE Transactions on Magnetics, vol. MAG-14, No. 5, Sep. 1978, pp. 671–673.
"Powder Metallurgy-Applied Products (II)-Magnetic Materials", 1964.
Ojima et al, "Magnetic Properties of a New Type of Rare-Earth Cobalt Magnets: $Sm_2(CO,Cu,Fe,M)_{17}$", IEEE Transactions on Magnetics, vol. MAG-13, No. 5, Sep., 1977, pp. 1317–1319.
Gupta et al, "Magnetization Process and Reversal in $Sm_3Co_{11}B_4$", Journal of Magnetism and Magnetic Materials, vol. 40, 1983, pp. 32–36.
Chikazumi et al, "Magnetic Body Handbook", 1975.
Chikazumi "Physics of Magnetism", pp. 18, 498–499.
Mainichi Daily News, Saturday, Jun. 4, 1983, "Strongest Magnet Unveiled".
"Hard Magnetic Material", vol. 3, Magnetic Engineering Seminar, edited by Ida et al.
Japanese High Technology, Aug. 1984, vol. 4, No. 5.
"Neomax-Neodimium Iron Magnet—", Sumitomo Special Metals Co., Ltd.
Kaneko et al, "Magnetic Materials", Nov. 1977.
Hadjipanayis et al, "Investigation of Crystalline Iron--Platinum Nickel and Amorphous Rare-Earth Alloys for Permanent Magnets", Mar. 15, 1983, pp. 1–79 w/Appendix.
Koo, "Partial Substitution of Sm with Neodymium, Praseodymium, and Mischmetal In $RE_2TM_{17}$ Permanent Magnets", IEEE Transactions on Magnetics, vol. MAG-20, No. 5, Sep. 1984, pp. 1593–1595.
"Magnetic Materials of Modern Age", edited by Mito-Kako-Gijutsu Kyokai, Jun. 5, 1981.
Givord et al, "Crystal Chemistry and Magnetic Properties of the $R_2Fe_{14}B$ Family of Compounds", Oct. 25, 1984, pp. 131–142.
Lee, "Hot-Pressed Neodymium-Iron-Boron Magnets", Appl. Phys. Lett., vol. 46, Apr. 15, 1985, pp. 790–791.
Hadjipanaysis et al, "Electronic and Magnetic Properties of Rare-Earth-Transition-Metal Glasses", Sep. 27, 1979, pp. 101–107.
Burzo, "Some New Results in the Field of Magnetism of Rare Earth Compounds", Acta Physica Polonica, Mar., 1985, pp. 1–17 w/drawings.
Ormerod, "Processing and Physical Metallurgy of NdFeB and Other Rare Earth Magnets", pp. 69–92, Oct. 1984.
Croat, "Magnetic Hardening of Pr-Fe and Nd-Fe Alloys by Melt Spinning", J. Appl. Phys., Apr. 4, 1982, pp. 3161–3169.
Handbook on the Physics and Chemistry of Rare Earths, vol. 2, Chapter 15, pp. 231–241, 1979.
Greedan et al, "An Analysis of the Rare Earth Contribution to The Magnetic Anistropy in $RCo_5$ and $R_2Co_{17}$ Compounds", Journal of Solid State Chemistry, vol. 6, 1973, pp. 387–395.
IEEE Trans. on Magnetics., vol. MAG-18, No. 6, Nov. 1982, pp. 1448–1450, Koon et al, "Composition Dependence of the Coercive".
Ray et al, "Easy Directions of Magnetization in Ternary $R_2(Co,Fe)_{17}$ Phases", IEEE Transactions on Magnetics, Sep. 1972, pp. 516–518.
Lee, "The Future of Rare Earth-Transition Metal Magnets of Type $RE_2TM_{17}$", J. Appl. Phys., vol. 52, Mar., 1981, pp. 2549–2553.
IEEE Trans. on Magnetics, vol. MAG-20, No. 5, part 2, Sep., 1984, pp. 1584–1589, Sagawa et al, "Permanent Magnet Materials . . . ".
Ohashi et al, "Effects of Prasedymium Substitution on Precipitation Hardened Rare Earth Magnets", pp. 493–501.
Handbook on the Physics and Chemistry of Rare Earths, vol. 2, Chapter 14, pp. 55–56, 155–161, 1979.
Croat, "Pr-Fe and Nd-Fe-Based Materials: A New Class of High-Performance Permanent Magnets", J. Appl. Phys., vol. 55, Mar. 15, 1984, pp. 2078–2082.
Neumann et al, "Line Start Motors Designed with Nd--Fe-B Permanent Magnets", pp. 77–89, May 1985.
J. J. Croat, "Permanent Magnet Properties of Rapidly Quenched Rare Earth-Iron Alloys", IEEE Trans. Mag., vol. MAG-18, No. 6, Nov., 1982, pp. 1442–1447.
Chaban et al, "Ternary Nd, Sm, Gd-Fe-B Systems", LVOV State University, pp. 873–875.
R. K. Mishra, "Microstructure of Melt-Spun Neodymium-Iron-Boron Magnets", International Conference on Magnetism 1985.

(List continued on next page.)

OTHER PUBLICATIONS

Leamy et al, "The Structure of Co-Cu-Fe-Ce Permanent Magnets", IEEE Transactions on Magnetics, vol. MAG-9, No. 3, Sep. 1973, pp. 205-209.

Melton et al, "A Electron Microscope Study of Sm-Co-Cu-Based Magnetic Materials with the $Sm_2Co_{17}$ Structure", J. Appl. Phys., vol. 48, No. 6, Jun., 1977, pp. 2608-2611.

Senno et al, "Magnetic Properties of Sm-Co-Fe-Cu Alloys for Permanent Magnetic Materials", Japan J. Appl. Phys., vol. 14, (1975), No. 10, pp. 1619-1620.

Croat, "Preparation and Coercive Force of Melt-Spun Pr-Fe Alloys", Appl. Phys. Lett., vol. 37, Dec. 15, 1980, pp. 1096-1098.

Koon et al, "A New Class of Melt Quenched Amorphous Magnetic Alloys", Naval Research Lab., Washington, D.C., PACS No. 75.50Kj, 75.60Gm.

Koon et al, "Rare-Earth Transition Metal Exchange Interactions In Amorphous $(Fe_{0.82}B_{0.18})_{0.9}R_xLa_{0.1-x}$ Alloys", J. Appl. Phys., vol. 53, Mar., 1982, pp. 2333-2334.

Koon et al, "Magnetic Properties of Amorphous and Crystallized $(Fe_{0.82}B_{0.18})_{0.9}Tb_{0.05}La_{0.05}$", Appl. Phys. Lett., vol. 39, Nov. 15, 1981, pp. 640-642.

Handbook on the Physics and Chemistry of Rare Earths, vol. 2, Chapter 16, "Amorphous Magnetic Rare Earth Alloys", pp. 259-294, 1979.

Sagawa et al, "Permanent Magnet Materials Based on the Rare Earth-Iron-Boron Tetragonal Compounds", The Research Institute for Iron, Steel and Other Metals, Tohoku University, Japan, 1984.

Nezu et al, "$Sm_2(Co, Fe, Cu)_{17}$ Permanent Magnet Alloys with Additive Element Hf", pp. 437-449, 1979.

Sagawa et al, "New Material for Permanent Magnets on a Base of Nd, and Fe", J. Appl. Phys., vol. 55, Mar. 15, 1984, p. 2083.

Kabacoff et al, "Thermal and Magnetic Properties of Amorphous $Pr_x(fe_{0.8}B_{0.2})_{1-x}$", J. Appl. Phys., vol. 53, Mar., 1982, pp. 2255-2257.

Koon et al, "Crystallization of FeB Alloys with Rare Earth to Produce Hard Magnetic Materials", J. Appl. Phys. vol. 55, Mar. 15, 1984, pp. 2063-2066.

Croat et al, "High-Energy Produce Nd-Fe-B Permanent Magnets", Appl. Phys. Lett., vol. 44, Jan., 1984, pp. 148-149.

El Masry, et al, "Magnetic Moments and Coercive Forces in the Hexagonal Boride Homologous Series $Co_{3n+5}R_{n+1}B_{2n}$ with R=Gd and Sm", pp. 33-37, 1983.

Stadelmaier, "Cobalt-Free and Samarium-Free Permanent Magnet Materials Based on an Iron-Rare Earth Boride", Dept. of Materials Eng., N.C. State University, Sep. 1, 1983, pp. 1-9.

Herbst et al, "Relationships Between Crystal Structure and Magnetic Properties in $Nd_2Fe_{14}B$", Phys. Dept., General Motors Res. Lab., pp. 1-10.

Stadelmaier, "The Neodymium-Iron Permanent Magnet Breakthrough", Magnetic Materials Products Assoc., Jan., 1984, pp. 1-15.

Topp, "The Chemistry of the Rare-Earth Elements", Topics in In-Organic and General Chemistry, 1965, pp. 1-12.

El Masry et al, "Substitution of Iron for Cobalt in Rare Earth Boride Permanent Magnets of the Type $Co_{3n+5}Sm_{n+1}B_{2n}$", Dept. of Materials, N.C. State Un., Feb., 1983, pp. 86-88.

ISOTROPIC PERMANENT MAGNETS AND PROCESS FOR PRODUCING SAME

FIELD OF THE INVENTION

The present invention relates generally to isotropic permanent magnets and, more particularly, to novel magnets based on FeBR alloys and expressed in terms of FeBR and FeBRM.

In the present disclosure, the term "isotropy" or "isotropic" is used with respect to magnetic properties. In the present invention, R is used as a symbol to indicate rare-earth elements including yttrium Y, M is used as a symbol to denote additional elements such as Al, Ti, V, Cr, Mn, Zr, Hf, Nb, Ta, Mo, Ge, Sb, Sn, Bi, Ni and W, and A is used as a symbol to refer to elements such as copper Cu, phosphorus P, carbon C, sulfur S, calcium Ca, magnesium Mg, oxygen O and silicon Si.

BACKGROUND OF THE INVENTION

Permanent magnets are one functional material which is practically indispensable for electronic equipment. The permanent magnets current in use mainly include alnico magnets, ferrite magnets, rare earth-cobalt (RCo) magnets and more. With remarkable advances in semiconductor devices in recent years, it is increasingly required to miniaturize and upgrade the parts corresponding to hands and feet or mouths (voice output devices) thereof. The permanent magnets used therefor are required to possess high properties correspondingly.

Although, among permanent magnets, the isotropic permanent magnets are inferior to the anisotropic magnets in certain points in view of performance, the isotropic magnets find good use due to such magnetic properties that no limitation is imposed upon the shape and the direction of magnetization. However, there is much to be desired in performance. The anisotropic magnets rather than the isotropic magnets are generally put to practical use due to their high performance. Although the isotropic magnets are substantially formed of the same material as the anisotropic magnets, for instance, alnico magnets, ferrite magnets, MnAl magnets and FeCrCo magnets show a maximum energy product (BH)max os barely 2 MGOe. SmCo magnets broken down into RCo magnets show a relatively high value on othe order of 4–5 MGOe, which is nonetheless only ¼–1/6 times those of the anisotropic magnets. In addition, the SmCo magnets still offer some problems in connection with practicality, since they are very expensive because of the fact that samarium Sm which is rare is needed, and that it is required to use a large amount, i.e., 50–60 weight % of cobalt Co, the supply of which is uncertain.

It has been desired in the art to use relatively abundant light rare earth elements such as, for example, Ce, Nd, Pr and the like in place of Sm belonging to heavy rare earth and substitute Co with Fe. However, it is well-known that light rare earth elements and Fe do not form intermetallic compounds suitable for magnets, even when they are mutually melted in a homogeneous state, and crystallized by cooling. Furthermore, an attempt made to improve the magnetic force of such light rare earth-Fe alloys through powder metallurgical manners was also unsuccessful (see JP Patent Kokai (Laid-Open) Publication No. 57 (1982)-210934, pp. 6).

On the other hand, it is known that amorphous alloys based on (Fe, Ni, Co)-R can be obtained by melt-quenching. In particular, it has been proposed (in the aforesaid Publication No. 57-210934) to prepare amorphous ribbons from binary alloys based on FeR (as R use is made of Ce, Pr, Nd, Sm, Eu, etc.), especially FeNd and magnetizing the ribbons, whereby magnets are obtained. This process yields magnets having (BH)max of 4–5 MGOe. However, since the resulting ribbons have a thickness range from several microns to a few tens of microns, they should be laminated or compacted after pulverization in order to obtain magnets of practical bulk. With any existing methods, a lowering of density and a further lowering of magnetic properties would take place. After all, it is not feasible to introduce improvements in magnetic properties.

SUMMARY OF THE INVENTION

It is a principal object of the present invention to provide novel permanent magnets superseding the conventional isotropic permanent magnet materials.

More particularly, the present invention aims at providing isotropic permanent magnets (and materials) having magnetic properties equivalent to, or greater than, those of the conventional products, in which relative abundant materials, especially Fe, and relatively abundant rare-earth elements are mainly used, and in which Sm and the like having problems in availability are not necessarily used as R.

Furthermore, the present invention aims at providing isotropic permanent magnets having improved magnetic properties such as improved coercive force.

In addition, the present invention aims at providing isotropic permanent magnets which are inexpensive, but are of sufficient practical value.

The present invention also aims at providing a process for the production of these magnets.

According to 1st–3rd aspects of the present invention, there are provided magnetically isotropic sintered permanent magnets based on FeBR type compositions. More specifically, according to the first aspect, there is provided an isotropic sintered permanent magnet based on FeBR; according to the second aspect, there is provided an FeBR base magnet, the mean crystal grain size of which is 1–160 microns after sintering; and according to the third aspect, there is provided a process for the production of the FeBR base, isotropic sintered permanent magnets as referred to in the first and second aspects.

The 4th–6th aspects of the present invention relate to FeBRM type compositions. More specifically, according to the fourth aspect, there is provided an isotropic permanent magnet based on FeBRM; according to the fifth aspect, there is provided a FeBRM base magnet, the mean crystal grain size of which is 1–100 microns after sintering; and according to the sixth aspect, there is provided a process for the production of the magnets is referred to in the fourth and fifth aspects.

The seventh aspect of the present invention is concerned with an allowable level of impurities, which is applicable to the FeBR and FeBRM systems alike, and offers advantages in view of the practical products and the process of production thereof as well as commercial productivity.

In the present disclosure, "%" means "atomic %" unless otherwise specified. first aspect of the present invention are characterized in that they have a composition (hereinafter referred to "the FeBR composition or system") comprising, in atomic percent, 10–25% of R, 3–23% of boron B and the balance being iron Fe and inevitable impurities, are isotropic, and are obtained as sintered bodies by powder metallurgy.

The isotropic permanent magnets according to the second aspect of the present invention are characterized in that they have the aforesaid FeBR composition, and the sintered bodies have a mean crystal grain size of 1–160 microns after sintering.

The process of producing according to the third aspect of the present invention will be described later together with that according to the sixth aspect of the present invention.

The present inventors already inverted FeBR base, anisotropic permanent magnets in which Sm and Co were not necessarily used. As a result of intensive studies of isotropic permanent magnets, it has further been found that permanent magnets showing good isotropy can be obtained from the FeBR systems with the application of sintering. Based on such findings, the present invention has been accomplished. The FeBR based, isotropic permanent magnets obtained according to the present invention have properties equivalent to, or greater than, those of the SmCo based, isotropic magnets, and are inexpensive and of extremely high practical value, since expensive Sm is not necessarily used and there is no need of using Co.

In the present invention, the term "isotropy" is used to indicate one of the properties of the permanent magnets and means that they are substantially isotropic, i.e., in a sense that no magnetic field is impressed during compacting or forming, and also includes isotropy that may appear by compacting or forming.

The isotropic sintered permanent magnets according to the fourth aspect of the present invention have a composition based on FeBRM (hereinafter referred to "the FeBRM composition or system"), which comprises, in atomic percent, 10–25% of R (provided that R is at least one of rare-earth elements including Y), 3–23% of boron B, no more than given percents (as specified below) of one or two or more of the following additional elements M (exclusive of M=0%, provided that, when two or more additional elements M are added, the combined amount of M is no more than the maximum value among the values, specified below, of said elements M actually added), and the balance being Fe and inevitable impurities entrained from the process of production:

9.5% Al, 4.7% Ti, 10.5% V, 8.5% Cr, 8.0% Mn, 5.5% Zr, 5.5% Hf, 12.5% Nb, 10.5% Ta, 8.7% Mo, 6.0% Ge, 2.5% Sb, 3.5% Sn, 5.0% Bi, 4.7% Ni, 8.8% W.

According to the fifth aspect of the present invention, there is provided the permanent magnet of the fourth aspect in which the sintered body has a mean crystal grain size ranging from about 1 micron to about 100 microns.

The isotropic sintered permanent magnets according to the seventh aspect of the present invention comprises the FeBR and FeBRM compositions in which one or more of A are further contained in given percents. A stands for no more than 3.3% copper Cu, no more than 2.5% sulfur S, no more than 4.0% carbon C, no more than 3.3% phophorus P, each no more than 4.0% Ca and Mg, no more than 2.0% O and no more than 5.0% Si. It is noted that the combined amount of A is no more than the maximum value among the values specified above of said elements A actually contained, and, when M and a are contained, the sum of M plus A is no more than the maximum value among the values specified above of said elements M and A actually added and contained.

The permanent magnets are obtained as magnetically isotropic sintered bodies, a process for the preparation of which is herein disclosed and characterized in that the respective alloy powders of the FeBR and FeBRM compositions are compacted, followed by sintering (the third and sixth aspects). It is noted that the alloy powders are novel and crystalline rayther than amorphous. For instance, the starting alloys are prepared by melting, and cooled. The thus cooled alloys are pulverized, compacted under pressure and sintered resulting in isotropic permanent magnets. Cooling of the molten alloys may usually be done by casting and other cooling manners.

Preferred embodiments of the present invention will now be explained in further detail with reference to the accompanying drawings illustrating examples. It is understood that the present invention is not limited to the embodiments illustrated in the drawings.

GENERAL AND FIRST ASPECT

The FeBR, FeBRA, FeBRM and FeBRMA systems of the present invention are all based on the FeBR systems, and are similarly determined in respect of the ranges of B and R.

Figure 2:
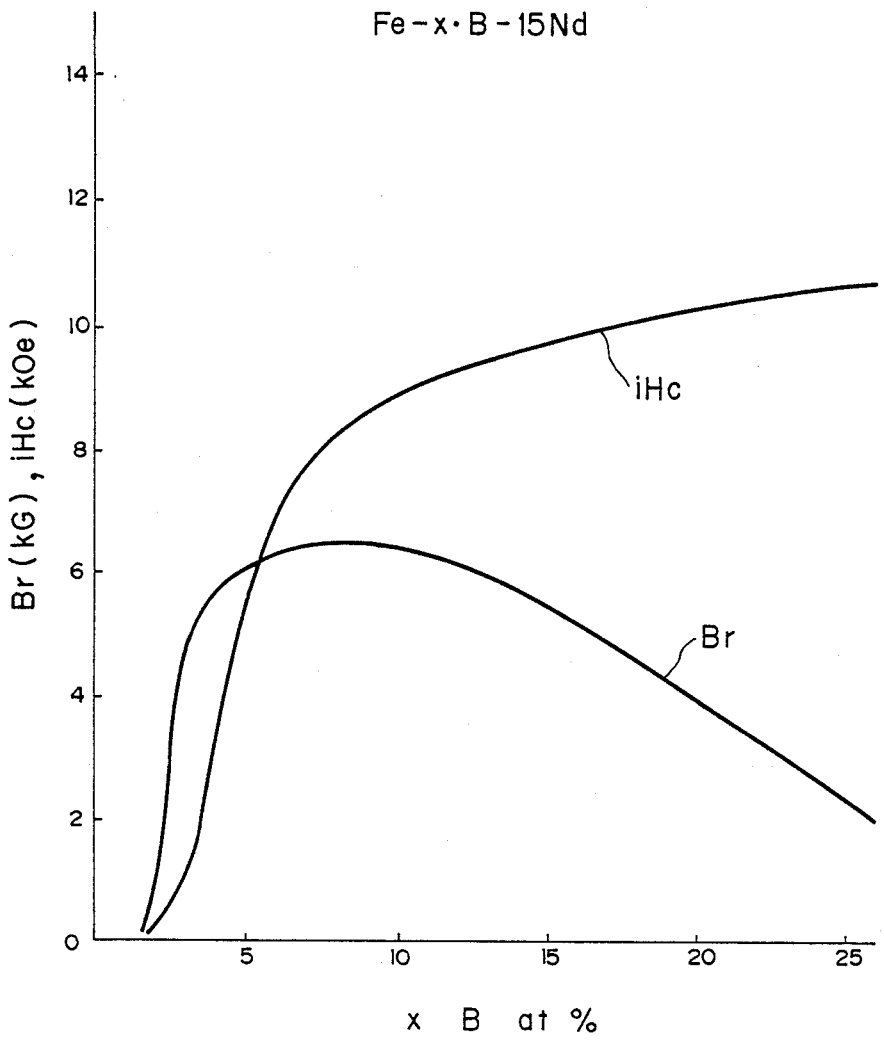
FIG. 2 is a graph showing the relationship between the amount of B and iHc as well as Br.
Figure 6:
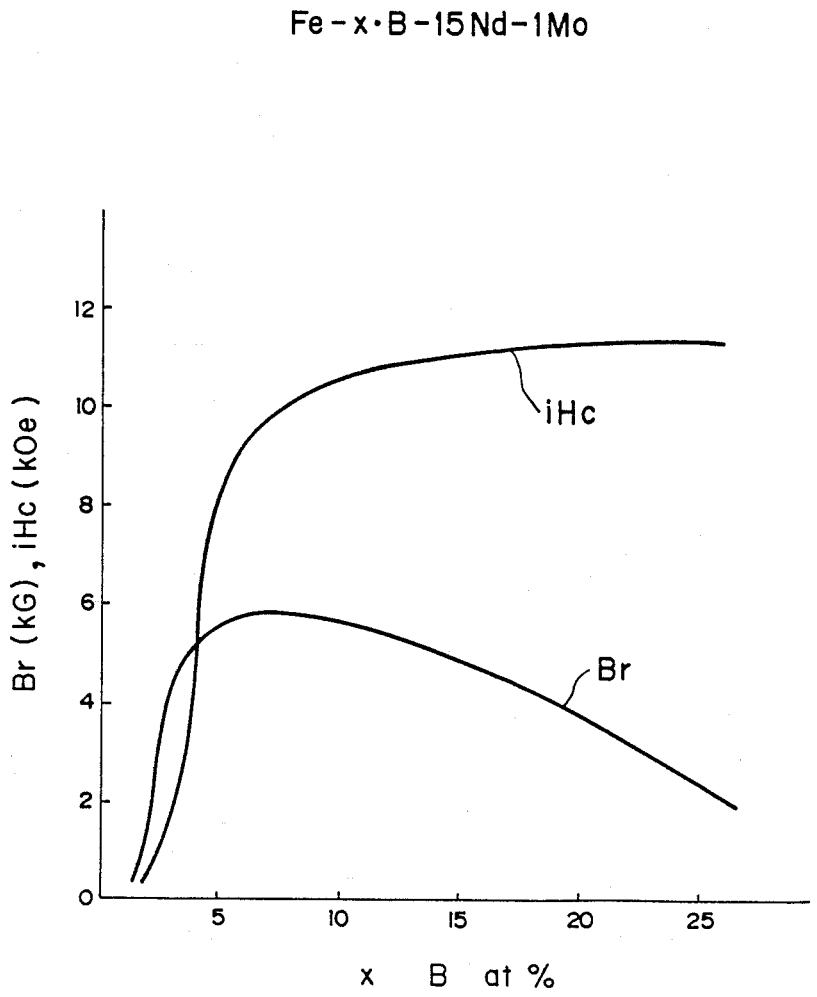

To meet a coercive force iHc of no less than 1 kOe, the amount of B should be no less than 3 atomic % (hereinafter "%" stands for the atomic percent in the alloys) in the present invention. An increase in the amount of B increases iHc but decreases Br (see FIGS. 2 and 6). Hence, the amount of B should be no more than 23% to obtain Br of at least 3 kG and to achieve (BH)max of no less than 2 MGOe.

Figure 1:
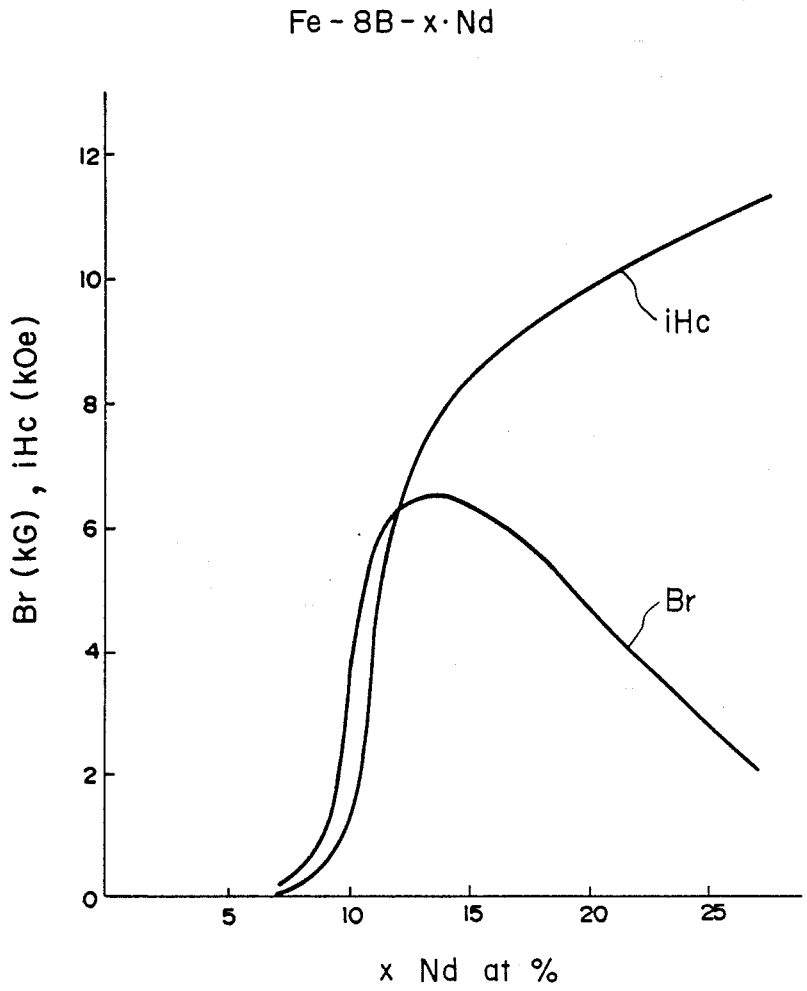
FIG. 1 is a graph showing the relationship between the amount of R (Nd) and coercive force iHc as well as residual magnetic flux density Br.
Figure 5:
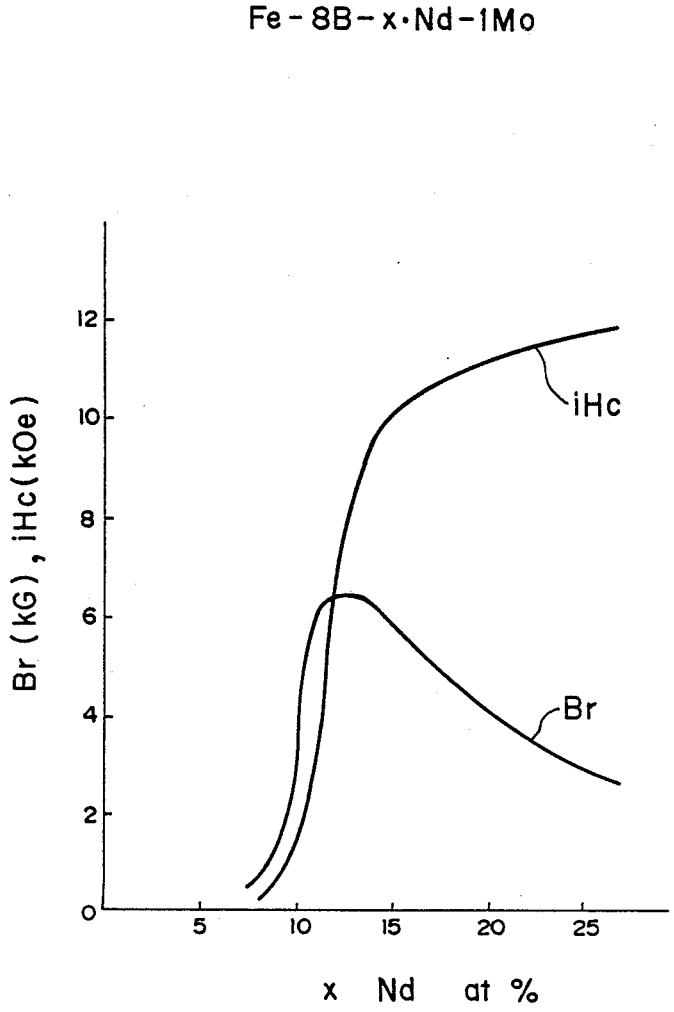
FIGS. 5 and 6 are graphs showing the amounts of R and B, and Br and iHc of the FeBRM systems (Fe-8B-xNd-1Mo, Fe-xB-15Nd-1Mo), respectively.

FIGS. 1 and 5 (wherein M denotes Mo) are illustrative of the relationship between the amount of R and iHc as well as Br in the FeBR and FeBRM systems. As the amount of R increases, iHc increases, but Br increases then decreases depicting a peak. Hence, the amount of R should be no less than 10% to obtain (BH)max of no less than 2 MGOe, and should be no more than 25% for similar reasons and due to the fact that R is expensive, and so likely to burn that difficulties are involved in technical handling and production.

Preferable with respect to Fe, B and R are the FeBR compositions in which R is 12–20% with the main component being light rare earth such as Nd or Pr (the light rare earth amounting to 50% or higher of the overall R), B is 5–18% and the balance is Fe, and the FeBRM compositions wherein the aforesaid ranges hold for Fe, B and R, and M is further within a range providing at least 4 kG Br, since it is then possible to achieve high magnetic properties represented by (BH)max of no less than 4 MGOe.

Most preferably with respect to Fe, B and R are the FeBR compositions in which R is 12–16% with the main component being light rare earth such as Nd or Pr, B is 6–18% and the balance being Fe, and the FeBRM compositions wherein the aforesaid ranges hold for Fe, B and R, and M is within a range providing at least 6 kG Br, since it is then possible to achieve high properties represented by (BH)max of no less than 7 MGOe, which has never been obtained in the conventional isotropic permanent magnets.

The present invention is very useful, since the raw materials are inexpensive owing to the fact that relatively abundant rare earth elements which are might otherwise find no wide use elsewhere can be used as R, and that Sm is not necessarily used, and may not be used as the main ingredient.

Besides Y, R used in the permanent magnets of the present invention includes light- and heavy-rare earth, and at least one thereof may be used. That is, use may be made of Nd, Pr, lanthanum La, cerium Ce, terbium Te, dysprosium Dy, holmium Ho, erbium Er, europium Eu, samarium Sm, gadolinium Gd, promethium Pm, thulium Tm, ytterbium Yb, lutetium Lu, Y and the like. It suffices to use light rare earth as R, and particular preference is given to Nd and Pr, e.g., no less than 50% of R or mainly of R. Usually, it suffices to use one element as R, but, practically, use may be made of mixtures of two or more elements such as mischmetal, dydimium, etc. due to easiness in availability. Sm, La, Ce, Gd, Y, etc. may be used in the form of mixtures with light rare earth such as Nd and Pr. R may not be pure light rare-earth elements, and contain inevitable impurities entrained from the process of production (other rare-earth elements, Ca, Mg, Fe, Ti, C, O, etc.), as long as such R is industrially available.

The starting B may be pure boron or alloys of B with other constitutional elements such as ferroboron, and may contain as impurities Al, C, silicon Si and more. The same holds for all the aspects of the present invention.

THIRD ASPECT

(Producing Process)

The FeBR base permanent magnets disclosed in the prior application are obtained as magnetically anisotropic sintered bodies, and the permanent magnets of the present invention are obtained as similar sintered bodies, except that they are isotropic. In other words, the isotropic permanent magnets of the present invention are obtained by preparing alloys, e.g., by melting and cooling and pulverizing, compacting and sintering the alloy compacts.

Melting may be carried out in vacuo or in an inert gas atmosphere, and cooling may be effected by, e.g., casting. For casting, a mold formed of copper or other metals may be used. In the present invention, it is desired that a water-cooled type mold is used with the application of a rapid cooling rate to prevent segregation of the ingredients of ingot alloys. After sufficient cooling, the alloys are coarsely ground in a stamp mill or like means and, then, finely pulverized in an attritor, ball mill or like means to no more than about 400 microns, preferably 1–100 microns.

In addition to the aforesaid pulverization manner, mechanical pulverization means such as spraying and physicochemical pulverization means such as reducing or electrolytic means may be relied upon for the pulverization of the FeBR base alloys. The alloys of the present invention may be obtained by a so-called direct reduction process in which the oxides of rare earth are directly reduced in the presence of other constitutional elements (e.g., Fe and B or an alloy thereof) with the use of a reducing agent such as Ca, Mg or the like.

The finely pulverized alloys are formulated into a given composition. In this case, the FeBR base or mother alloys may partly be added with constitutional elements or alloys thereof for the purpose of adjusting the composition. The alloy powders formulated to the given composition are compacted under pressure in the conventional manner, and the resultant compact is sintered at a temperature approximately of 900°–1200° C., preferably 1050°–1150° C. for a given period of time. It is possible to obtain the isotropic sintered magnet bodies having high magnetic properties by selecting the sintering conditions (especially temperature and time) in such a manner that the mean crystal grain size of the sintered bodies comes within the predetermined range after sintering. For instance, sintered bodies having a preferable mean crystal grain size can be obtained by compacting the starting alloy powders having a particle size of no more than 100 microns, followed by sintering at 1050°–1150° C. for 30 minutes to 8 hours.

It is noted that sintering is carried out preferably in vacuo or in an inert gas atmosphere which may be vacuo or reduced pressure, e.g., $10^{-2}$ Torr or less or inert or reducing gas with a purity of 99.9% or higher at 1–760 Torr. During compacting, use may be made of bonding agents such as camphor, paraffin, resins, ammonium chloride or the like and lubricants or compacting aids such as zinc stearate, calcium stearate, paraffin, resins or the like.

EXAMPLES

(First-Third Aspects)

The first-third aspects of the present invention will now be elucidated with reference to examples, which are given for the purpose of illustration alone and are not intended to impose any limitation upon the present invention.

Samples of 77Fe-8B-15Nd were prepared by the following steps. In what follows, the unit of purity is weight %.

(1) Referring to the starting materials, electrolytic iron of 99.9% purity was used as Fe; a ferroboron alloy containing 19.4% of B with the balance being Fe and impurities of Al, Si and C as B; and rare earth of 99.7% purity or higher as R (impurities were mainly other rare-earth metals). These materials were formulated into a given atomic ratio, melted and cast in a water-cooled copper mold.

(2) The cooled alloy was coarsely stemp-milled to 35-mesh through and, then, finely pulverized for 3 hours in a ball mill to 3–10 microns.

(3) The resultant powders were compacted under a pressure of 1.5 t/cm$^2$.

(4) Sintering was carried out at 1000°-1200° C. for 1 hour in argon in such a manner that the mean crystal grain size of the sintered body came within a range of 5-30 microns, followed by allowing the body to cool which resulted in the samples.

The permanent magnet samples shown in Table 1 prepared by the foregoing steps were measured for the magnetic properties iHc, Br and (BH)max thereof. Table 1 shows the magnetic properties of the individual samples at room temperature.

Within the given ranges of the respective ingredients, iHc of no less than 1 kOe and Br of no less than 3 kG were obtained. (BH)max of no less than 2.0 MGOe was also obtained. Thus, high magnetic properties are obtained.

It is found that the combination of two or more rare-earth elements is also useful as R. To make a close examination of the relationship between the amounts of R and B and the magnetic properties, a number of samples were prepared by the same steps on the basis of Fe-8B-xNd systems wherein x=0-35% and Fe-xB-15Nd systems wherein x=0-30%. Tables 1 and 2 show the iHc and Br measurements of the samples.

TABLE 1

| | | magnetic properties | | |
|---|---|---|---|---|
| No. | compositions (at %) | iHc (kOe) | Br (kG) | (BH)max (MGOe) |
| C1 | 85Fe—15Nd | 0 | 0 | 0 |
| C2 | 55Fe—30B—15Nd | 10.8 | 1.8 | 0.7 |
| C3 | 76Fe—19B—5Pr | 0 | 0 | 0 |
| C4 | 53Fe—17B—30Nd | 13.5 | 2.2 | 1.0 |
| 1 | 82Fe—3B—15Nd | 1.7 | 5.2 | 2.0 |
| 2 | 80Fe—5B—15Nd | 3.4 | 5.3 | 4.5 |
| 3 | 77Fe—8B—15Nd | 8.5 | 6.4 | 8.7 |
| 4 | 68Fe—17B—15Nd | 7.2 | 4.8 | 4.6 |
| 5 | 70Fe—17B—13Nd | 5.3 | 4.9 | 4.8 |
| 6 | 65Fe—12B—22Pr | 11.0 | 3.4 | 2.3 |
| 7 | 63Fe—17B—10Nd—5Pr | 7.2 | 4.7 | 4.1 |
| 8 | 75Fe—10B—8Nd—7Pr | 7.4 | 6.2 | 7.8 |
| 9 | 68Fe—19B—8Nd—5Pr—2La | 6.6 | 3.6 | 2.6 |
| 10 | 75Fe—10B—18Ho | 6.0 | 3.2 | 2.1 |
| 11 | 70Fe—10B—10Er—5Pr | 4.7 | 3.1 | 2.2 |
| 12 | 75Fe—10B—10Nd—4Dy—1Sm | 3.8 | 5.3 | 3.6 |

Like the ferrite or RCo magnets, the permanent magnets of the FeBR base sintered bodies are the single domain, fine particle type magnets, which give rise to unpreferable magnet properties without being subjected to once pulverization followed by compacting under pressure and sintering.

With the single domain, fine particle type magnets, no magnetic walls are present within the fine particles, so that the inversion of magnetization is effected only by rotation, which contributes to further increases in coercive force.

Figure 3:
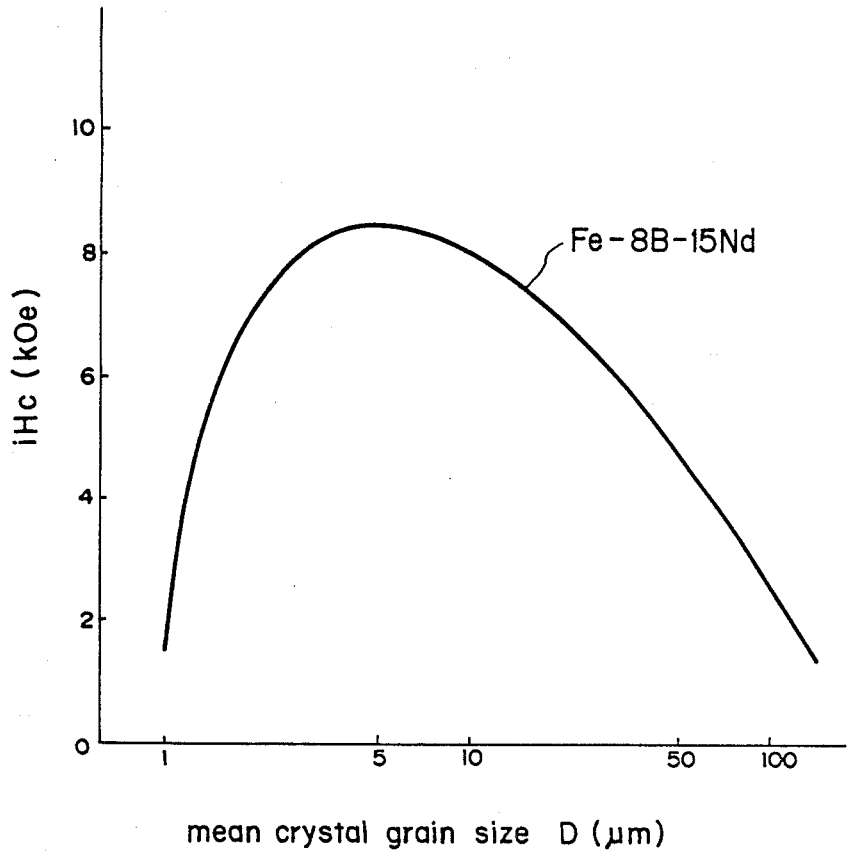
FIG. 3 is a graph showing the relationship between the the mean crystal grain size distribution and the coercive force in one example of the present invention.

To this end, the relationship was investigated between the crystal grain size and the magnetic properties, particularly iHc, of the permanent magnets of the FeBR base sintered bodies according to the present invention, based on the Fe-8B-15Nd systems. The results are given in FIG. 3.

The mean crystal grain size should be within a range of 1-160 microns to achieve iHc of no less than 1 kOe, and within a range of 1-110 microns to achieve iHc of no less than 2 kOe. A range of 1-80 microns is preferable, and a range of 3-10 microns is most preferble.

CRYSTAL STRUCTURE

The present inventors have already disclosed in detail the crystal structure of the magnetic materials and sintered magnets based on the FeBR base alloys in prior U.S. patent application Ser. No. 510,234 (filed July 1, 1983), the detailed disclosure of which is herewith referred to and incorporated herein, subject to the preponderance of the disclosure recited in this application. The same is also applied to the FeBRM system.

Referring generally to the crystal structure, it is believed that the magnetic material and permanent magnets based on the Fe-B-R alloy according to the present invention can satisfactorily exhibit their own magnetic properties due to the fact that the major phase is formed by the substantially tetragonal crystals of the Fe-B-R type. The Fe-B-R type alloy is characterized by its high Curie point and it has further been experimentally ascertained that the presence of the substantially tetragonal crystals of the Fe-B-R type contributes to the exhibition of magnetic properties. The contribution of the Fe-B-R base tetragonal system alloy to the magnetic properties is unknown in the art, and serves to provide a vital guiding principle for the production of magnetic materials and permanent magnets having high magnetic properties as aimed at in the present invention.

The tetragonal system of the Fe-B-R type alloys according to the present invention has lattice contents of ao: about 8.8 Å and Co: about 12.2 Å. It is useful where this tetragonal system compounds constitute the major phase of the Fe-B-R type magnets, i.e., it should occupy 50 vol % or more of the crystal structure in order to yield practical and good magnetic properties.

Besides the suitable mean crystal grain size of the Fe-B-R base alloys as discussed hereinabove the presence of a Rare earth (R) rich phase (i.e., including about 50 at % of R) serves to yield good magnetic properties, e.g., the presence of 1 vol % or more of such R-rich phase is very effective.

The Fe-B-R tetragonal system compounds are present in a wide compositional range, and may be present in a stable state also upon addition of certain elements other than R, Fe and B. The magnetically effective tetragonal system may be "substantially tetragonal" which term comprises ones that have a slightly deflected angle between a, b and c axes, i.e., within about 1 degree, or ones that have ao slightly different from bo, i.e., within about 1%.

The same is applied to the FeBRM system.

The aforesaid fundamental tetragonal system compounds are stable and provide good permanent magnets, even when they contain up to 1% of H, Li, Na, K, Be, Sr, Ba, Ag, Zn, N, F, Se, Te, Pb, or the like.

As mentioned above, contribution of the Fe-B-R type tetragonal system compounds to the magnetic properties have been entirely unknown in the art. It is thus a new fact that high magnetic properties suitable for permanent magnets are obtained by forming the major phases with these new compounds.

In the field of R-Fe alloys, it has been reported to prepare ribbon magnets by melt-quenching. However, the invented magnets are different from the ribbon magnets in the following several points. That is to say, the ribbon magnets can exhibit permanent magnetic properties in a transition stage from the amorphous or metastable crystal phase to the stable crystal state. Reportedly, the ribbon magnets can exhibit high coercive force only if the amorphous state still remains, or otherwise metastable $Fe_3B$ and $R_6Fe_{23}$ are present as the major phases. The invented magnets have no signs of an alloy phase remaining in the amorphous state, and the major phases thereof are not $Fe_3B$ and $R_6Fe_{23}$.

When the magnets of the present invention are prepared, use may be mde of granulated powders (on the order of several tens-several hundreds microns) obtained by adding binders and lubricants to the alloy powders. The binders and lubricants are not usually employed for the forming of anisotropic magnets, since they disturb orientation. However, they can be incorporated into the magnets of the present invention, since the inventive magnets are isotropic. Furthermore, the incorporation of such agents would possibly result in improvements in the efficiency of compacting and the strength of the compacted bodies.

In preferred embodiments, the isotropic permanent magnets obtained according to the present invention have the magnetic properties higher than those of all the existing isotropic permanent magnets and, moreover, do not rely upon expensive ingredients such as Sm and Co. The present invention is also highly advantageous in that it is possible to manufacture magnet products of practically sufficient bulk that is by no means achieved in the proposed amorphous ribbon process.

As stated in detail in the foregoing, the FeBR base isotropic permanent magnets according to the first-third aspects of the present invention give high magnetic properties, making use of inexpensive R materials such as light rare earth (especially Nd, Pr, etc.), particularly various mixtures of light- and heavy-rare earth.

FOURTH ASPECT

According to the fourth aspect of the present invention, additional elements M are added to the FeBR base alloys as disclosed in the first–third aspects to contemplate improving in principle the coercive force iHc thereof. Namely, the incorporation of M gives rise to a steep increase in iHc upon increase in the amount of B or R. Generally, as B or R increases Br rises and decreases after depicting a maximum value, wherein M brings about increase of iHc just in a maximum range of Br. As M, use may be made of one or more of Al, Ti, V, Cr, Mn, Zr, Hf, Nb, Ta, Mo, Ge, Sb, Sn, Bi, Ni and W. In general, the coercive force iHc drops with increases in temperature. However, it is possible to increase iHc at normal temperature by the addition of M, so that no demagnetization would take place upon exposure to elevated temperatures. However, as the amount of M increases, there is a lowering of Br and, resulting in a lowering of (BH)max, since M is (are) a nonmagnetic element(s) (save Ni). The M-containing alloys are very useful in recently increasing applications where higher iHc is needed even at the price of slightly reduced (BH)max, provided that (BH)max is no less than 2 MGOe.

Figure 7:
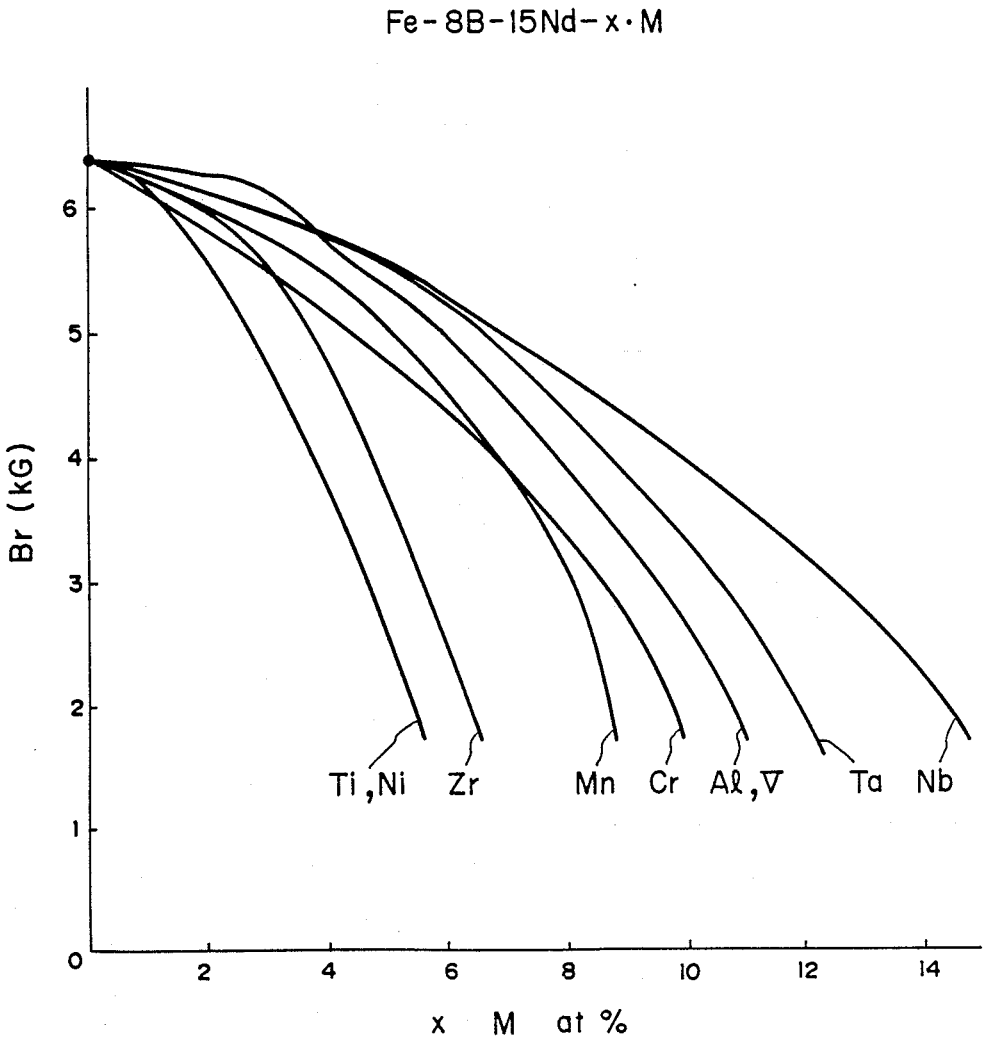
FIGS. 7 and 8 are graphs showing the relationship between the amount of M and Br in the FeBRxM system (Fe-8B-15Nd-xM)
Figure 8:
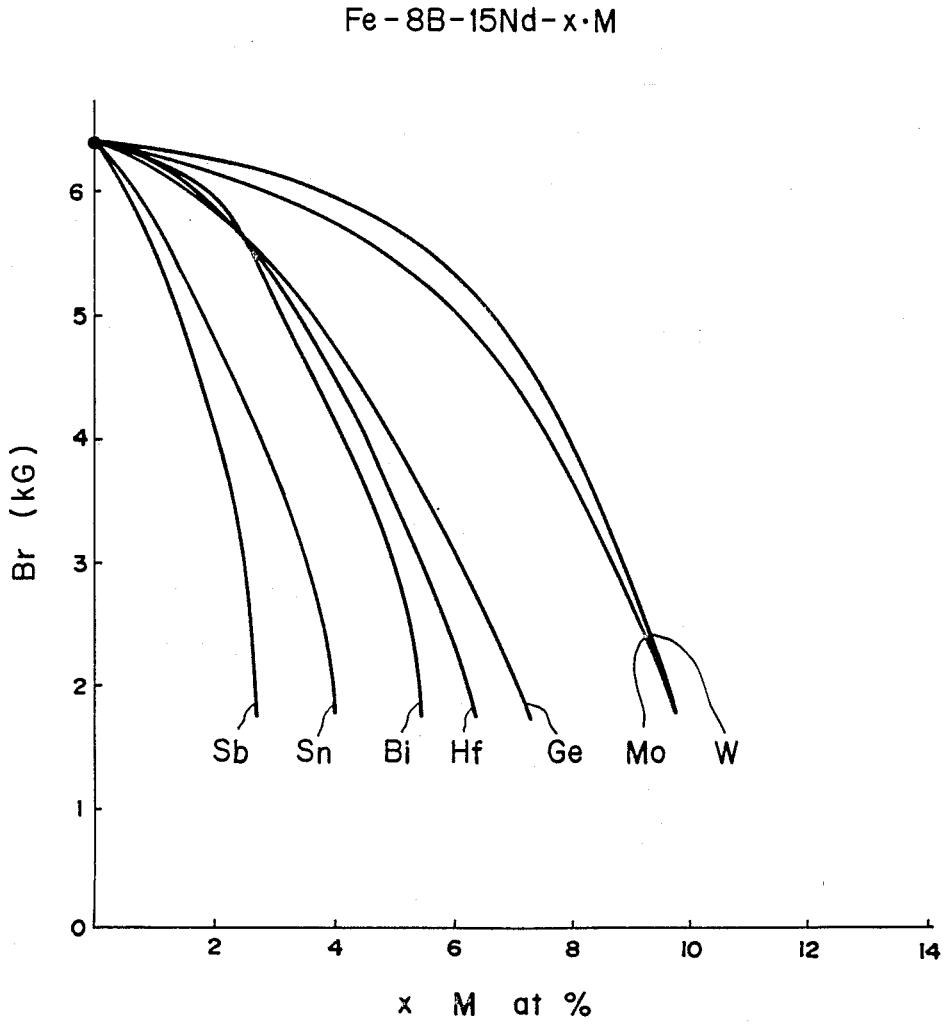

To study the effect of the addition of M upon Br, experiments were conducted in varied amounts of M. The results are shown in FIGS. 7 and 8.

It is preferred to make Br no less than 3 kG so as to make (BH)max equivalent to, or greater than, about 2 MGOe, the level of hard ferrite. As shown in FIGS. 7 and 8, the upper limits of M are as follows:

9.5% Al, 4.7% Ti, 10.5% V, 8.5% Cr, 8.0% Mn, 5.5% Zr, 5.5% Hf, 12.5% Nb, 10.5% Ta, 8.7% Mo, 6.0% Ge, 2.5% Sb, 3.5% Sn, 5.0% Bi, 4.7% Ni, 8.8% W.

When two or more elements M are added, the resulting properties appear by way of the synthesis of the properties of the individual elements, which varies depending upon the proportion thereof. The amounts of the individual elements M are within the aforesaid ranges, and the combined amount thereof is no more than the maximum values determined with respect to the individual elements which are actually added.

The addition of M incurs a gradual lowering of residual magnetization Br. Hence, according to the present invention, the amount of M is determined such that the obtained magnets have a Br value equivalent to, or greater than, that of the conventional hard ferrite magnets and a coercive force equivalent to, or greater than, that of the conventional products. Preferable amounts of M may be determined by selecting the amounts of M in which, e.g., Br of no less than 4.0 kG and no less than 6.0 kG or any desired value between Br of 2–6.5 kG or higher is obtained as shown in FIGS. 7 and 8.

Fundamentally, the addition of M has an effect upon the increase in coercive force iHc, which, in turn, increases the stability and, hence, the use of magnets.

Preferred is a range of M, as hereinbelow specified for obtaining Br of 4 kG or higher:

7.8% Al, 3.8% Ti, 7.8% V, 6.9% Cr, 6.9% Mn, 4.8% Zr, 4.5% Hf, 10.0% Nb, 8.8% Ta, 7.6% Mo, 5.0% Ge, 2.0% Sb, 2.7% Sn, 4.2% Bi, 3.8% Ni, and 7.9% W, wherein the same is applied when two or more of M are added.

More preferred is a range of M as hereinbelow specified for obtaining Br of 6 kG or higher:

3.4% Al, 1.3% Ti, 3.4% V, 1.5% Cr, 2.1% Mn, 1.9% Zr, 1.7% Hf, 2.8% Nb, 3.0% Ta, 2.8% Mo, 1.6% Ge, 0.5% Sb, 0.7% Sn, 1.9% Bi, 1.3% Ni, and 3.7% W, wherein the same is applied when two or more of M are added. The range of M is most preferably 0.1–3.7% to achieve (BH)max of about 7 MGOe, taking into cosideration effects thereof upon the increase in iHc and the lowering of Br as well as upon (BH)max. As M, V, Nb, Ta, Mo, W, Cr and Al are preferred, while a minor amount of Al is particularly useful.

The relationship between the amount of M and the coercive force has been established by way of a wide range of experiments.

FIFTH ASPECT

According to the fifth aspect of the present invention, it is clarified that good magnetic properties are achieved when the FeBRM base sintered bodies have a mean crystal grain size within a given constant range. That is, iHc of no less than 1 kOe is satisfied, when the mean crystal grain size of the sintered bodies is in a range of about 1 to about 100 microns. A preferable range is 1–80 microns, and a most preferable range is 2–30 microns, wherein further enhanced iHc is obtained.

This is substantially true of the FeBRM systems and the FeBRMA systems alike.

SIXTH ASPECT

Producing process is substantially the same as the third aspect except for preparation of the starting alloys or alloy powders. The additional elements M may be added to the FeBR base alloy(s) or may be prepared as FeBRM alloys. Minor amounts of alloys of the constitutional elements of Fe, B, R and M may be added to the mother alloys for formulating the final composition.

SEVENTH ASPECT

The permanent magnets according to the seventh aspect of the present invention may permit the entrainment or the elements A in quantities in or below given %. A includes Cu, S, C, P, Ca, Mg, O, Si and the like. When the FeBR and FeBRM base magnets are industrially prepared, such elements may often be entrained therein from the raw materials, the process of production, etc. For instance, when FeB is used as the raw material, S and P may often be entrained. In most cases, C remains as the residue of organic binders (compacting-aids) used in the process of powder metallurgy. Cu is frequently contained in cheap raw materials. Ca and Mg may easily be entrained from reducing agents. It has been observed that as the amount of entrained A increases, the residual magnetic flux density Br tends to drop.

Figure 4:
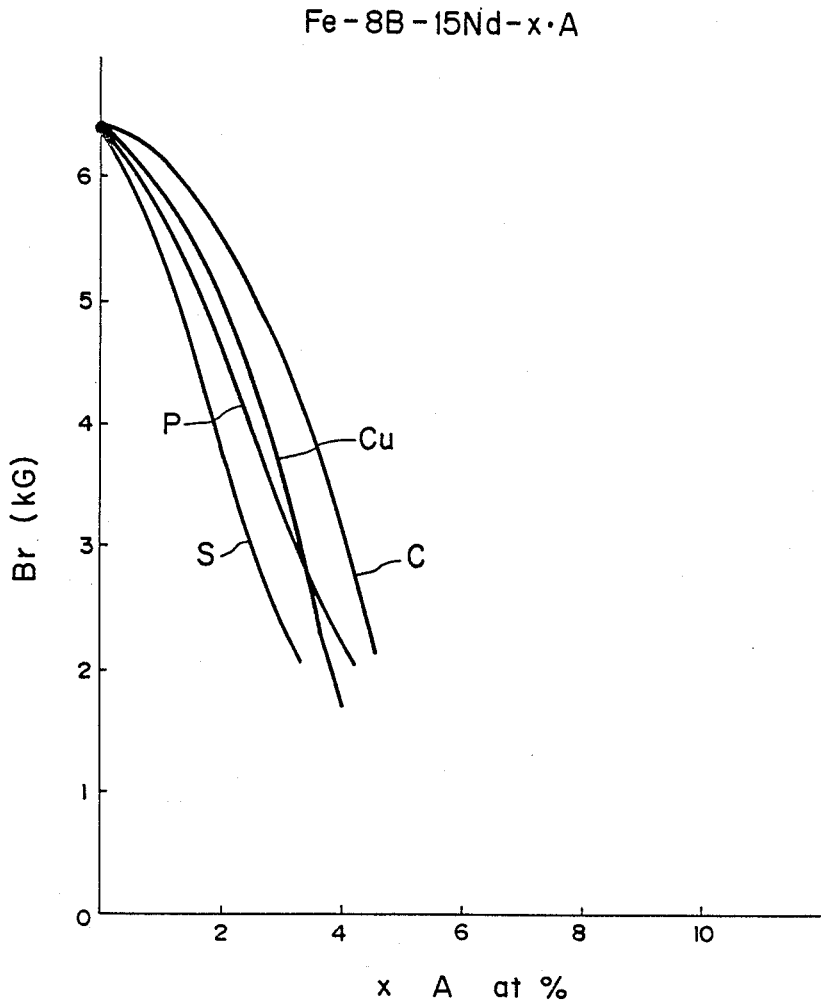
FIG. 4 is a graph showing the relationship between the amount of some of the elements A and Br in the FeBRA system (Fe-8B-15Nd-xA)

As a result, when the amounts of S, C, P and Cu are no more than 2.5%, 4.0%, 3.3% and 3.3%, respectively, the obtained properties (Br) are equal to, or greater than, those of hard ferrite (see FIG. 4). The allowable upper limits of O, Ca, Mg and Si are 2%, 4.0%, 4.0% and 5.0%, respectively.

When two or more elements A are entrained in the magnets, the properties of the individual elements are synthesized, and the total amount thereof is no more than the maximum value of the values, specified above, of the actually entrained A. Within this range, Br is equal to, or greater than, that of hard ferrite.

In the case of the FeBRMA base magnets in which the isotropic permanent magnets based on FeBRM contain further A, the combined amount of (M+A) is no more than the highest upper limit of the upper limits of the elements actually added and entrained, as is substantially the case with two or more M or A. This is because both M and A are apt to decrease Br. In the case of the addition of two or more M and the entrainment of two or more A, the resulting Br property appears through the synthesis of the effects of the individual elements upon Br, which varies depending upon the proportion thereof.

Al may be entrained from a refractory such as an alumina crucible into the alloys, but offers no disadantage since it is useful as M. M and A have no essential influence upon Curie point Tc, as long as they are within the presently claimed compositional range.

EXAMPLES

(Fourth–Sixth Aspects)

The fourth–sixth aspects of the present invention will now be explained in further detail with reference to examples, which are given for the purpose of illustration alone, and are not intended to place any limitation on the invention.

Prepared were the samples based on FeBRM and FeBRMA base alloys containing the given additional elements in the following manner.

(1) Referring to the starting materials, electrolytic iron of 99.9% purity was used as Fe; ferroboron alloys and boron of 99% purity used as B; and Nd, Pr, Dy, Sm, Ho, Er and Ce each of 99% purity or higher used as R (impurities were mainly other rare-earth metals). The starting materials were melted by high-frequency melting, and cast in a water-cooled copper mold. As M use was made of Ti, Mo, Bi, Mn, Sb, Ni, Ta, Sn and Ge each of 99% purity, W of 98% purity, Al of 99.9% purity, and Hf of 95% purity. Furthermore, ferrovanadium containing 81.2% of V, ferroniobium containing 67.6% of Nb, ferrochromium containing 61.9% of Cr and ferrozirconium containing 75.5% of Zr was used as V, Nb, Cr and Zr, respectively.

Where the elements A were contained, use was made of S of 99% purity or higher, ferrophosphorus containing 26.7% of P, C of 99% purity or higher, and electrolytic Cu of 99.9% purity or higher.

The unit of purity hereinabove is % by weight.

(2) Pulverization

Coarse pulverization was carried out to 35-mesh through in a stamp mill, and fine pulverization done in a ball mill for 3 hours to 3–10 microns.

(3) Compacting was effected under a pressure of 1.5 $t/cm^2$.

(4) Sintering was carried out at 1000°–1200° C. for 1 hour in argon in such a manner that the mean crystal grain size of the sintered bodies came within a range of 5–10 microns, followed by cooling down.

To investigate the magnet properties of the thus obtained samples having a variety of compositions, iHc, Br and (BH)max thereof were measured. Table 2 enumerates the permanent magnet properties, iHc, Br and (BH)max of the typical samples. Although not indicated numerically in the table, the balance is Fe.

TABLE 2

| No. | compositions (at %) | magnetic properties iHc (kOe) | Br (kG) | (BH)max (MGOe) |
|---|---|---|---|---|
| 1 | Fe—8B—15Nd | 8.5 | 6.4 | 8.7 |
| 2 | Fe—8B—10Nd—5Pr | 5.4 | 4.8 | 4.3 |
| 3 | Fe—17B—15Nd | 7.2 | 4.8 | 4.6 |
| C4 | Fe—15Nd—5Al | <1 | <1 | <1 |
| C5 | Fe—20Nd—3W | <1 | <1 | <1 |
| C6 | Fe—30B—15Nd—5Al | <1 | <1 | <1 |
| C7 | Fe—8B—30Nd—5Cr | >10 | <1 | <1 |
| C8 | Fe—17B—5Nd—2Al—1W | <1 | <1 | <1 |
| C9 | Fe—2B—15Nd—1W | 1.2 | 3.0 | <1 |
| 10 | Fe—8B—15Nd—1Ti | 9.2 | 5.9 | 6.9 |
| 11 | Fe—8B—15Nd—3V | 9.6 | 4.3 | 3.7 |
| 12 | Fe—8B—15Nd—1Nd | 10.0 | 6.1 | 7.9 |
| 13 | Fe—8B—15Nd—0.5Nb | 9.5 | 6.3 | 8.4 |
| 14 | Fe—8B—15Nd—5Nb | 11.0 | 4.4 | 3.9 |
| 15 | Fe—8B—15Nd—2Ta | 9.8 | 5.6 | 6.0 |
| 16 | Fe—8B—15Nd—2Cr | 10.1 | 4.3 | 3.7 |
| 17 | Fe—8B—15Nd—0.5Mo | 9.4 | 6.3 | 8.2 |
| 18 | Fe—8B—15Nd—1Mo | 10.2 | 5.8 | 6.8 |
| 19 | Fe—8B—15Nd—5Mo | 11.0 | 4.2 | 3.5 |
| 20 | Fe—8B—15Nd—0.5W | 10.5 | 5.9 | 7.4 |
| 21 | Fe—8B—15Nd—1W | 12.3 | 5.8 | 7.0 |
| 22 | Fe—8B—15Nd—5W | 13.3 | 4.0 | 3.1 |
| 23 | Fe—8B—15Nd—3Mn | 9.0 | 4.3 | 3.7 |
| 24 | Fe—8B—15Nd—3Ni | 8.4 | 4.9 | 4.7 |

TABLE 2-continued

| No. | compositions (at %) | magnetic properties iHc (kOe) | Br (kG) | (BH)max (MGOe) |
|---|---|---|---|---|
| 25 | Fe—8B—15Nd—0.5Al | 9.7 | 5.9 | 7.3 |
| 26 | Fe—8B—15Nd—2Al | 11.5 | 5.3 | 5.6 |
| 27 | Fe—8B—15Nd—5Al | 11.9 | 4.2 | 3.4 |
| 28 | Fe—8B—15Nd—0.5Ge | 8.9 | 5.7 | 6.2 |
| 29 | Fe—8B—15Nd—1Sn | 11.8 | 4.7 | 4.4 |
| 30 | Fe—8B—15Nd—1Sb | 10.1 | 4.6 | 4.1 |
| 31 | Fe—8B—15Nd—1Bi | 10.2 | 5.3 | 5.7 |
| 32 | Fe—8B—15Nd—3Ti | 9.1 | 4.7 | 4.4 |
| 33 | Fe—8B—15Nd—1Hf | 8.9 | 4.4 | 3.9 |
| 34 | Fe—8B—15Nd—1.5Zr | 10.3 | 4.7 | 4.3 |
| 35 | Fe—8B—15PR—2Mo | 8.8 | 5.4 | 6.0 |
| 36 | Fe—17B—15Pr—1Hf—2Al | 9.6 | 3.4 | 2.3 |
| 37 | Fe—8B—10Nd—5Pr—2Nb—2Ti | 9.9 | 4.1 | 3.4 |
| 38 | Fe—8B—20Nd—0.5Mo—0.5W—1Ti | 14.0 | 3.6 | 2.5 |
| 39 | Fe—8B—12Nd—3Dy—0.5Nb—0.5Ti | 9.2 | 4.1 | 3.4 |
| 40 | Fe—10B—14Nd—1Sm—1Al—0.5W | 12.2 | 4.3 | 3.7 |
| 41 | Fe—12B—10Nd—5Ho—2Nb | 7.5 | 4.7 | 4.2 |
| 42 | Fe—7B—19Nd—5Er—1Ta | 11.2 | 5.3 | 5.0 |
| 43 | Fe—8B—11Nd—4Ce—1Al | 5.3 | 4.9 | 4.8 |
| 44 | Fe—10B—15Nd—1Al—1P | 8.6 | 4.4 | 3.4 |
| 45 | Fe—7B—16Nd—1Ti—1C | 6.8 | 3.7 | 2.6 |
| 46 | Fe—8B—15Nd—1W—0.5Cu | 3.8 | 5.3 | 5.1 |
| 47 | Fe—9B—14Nd—1Si—1S | 5.1 | 3.4 | 2.1 |

Although the alloys containing as R Nd, Pr, Dy and Sm are exemplified, 15 rare-earth elements (Y, Ce, Sm, Eu, Tb, Dy, Er, Tm, Yb, Lu, Nd, Pr, Gd, Ho and La) show a substatially similar tendency. However, the alloys containing Nd and Pr as the main component are much more useful than those containing scarce rare earth (Sm, Y, heavy rare earth) as the main ingredient, since rare earth ores abound relatively with Nd and Pr and, in particular, Nd does not still find any wide use.

In Table 2, samples Nos. 4 through 9 inclusive are reference examples for the permanent magnets of the present invention.

Figure 9:
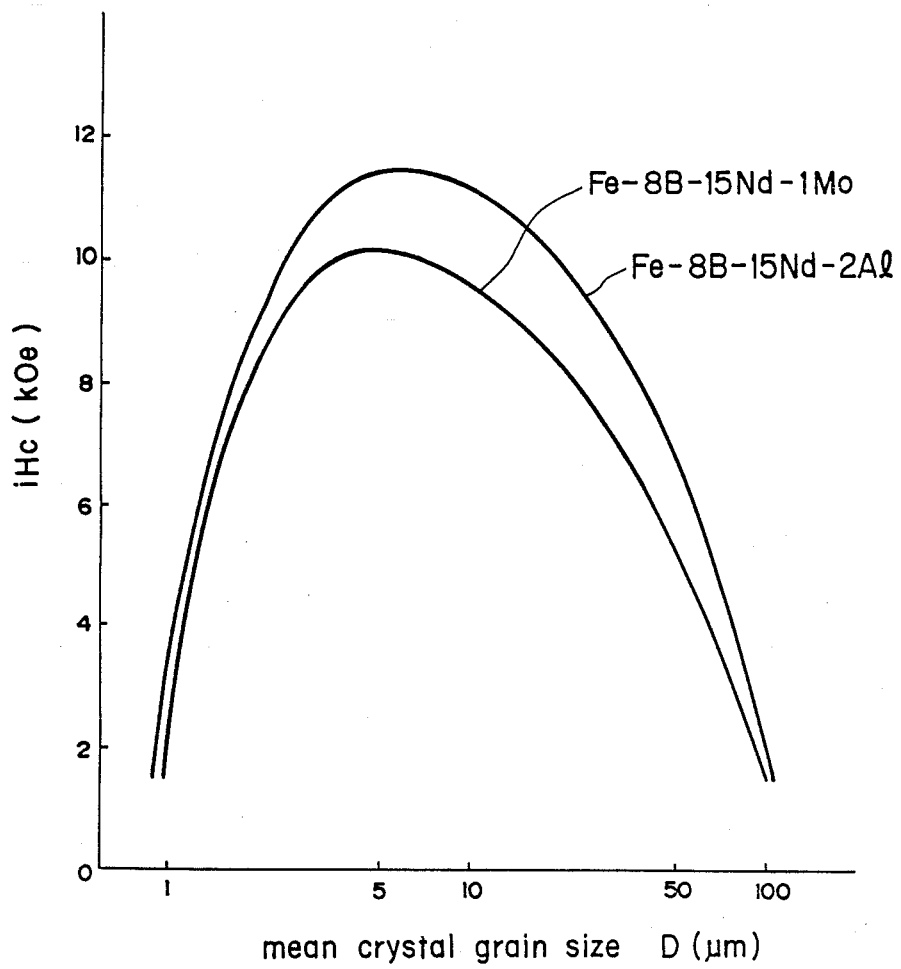
FIG. 9 is a graph showing the relationship between the the mean crystal grain size distribution of sintered bodies and iHc in the FeBRM systems (Fe-8B-15Nd-2Al and Fe-8B-15Nd-1Mo).

Out of the examples of the present invention shown in Table 2, examination was made of the relationship between the coercive force iHc and the mean crystal grain size D (microns) after sintering of Nos. 18 and 26. The results are shown in FIG. 9. Even with the same magnet, the coercive force varies depending upon the crystal grain size. Good results are obtained in a range of 2–30 microns, and a peak appears in a range of approximately 3–10 microns.

From this, it is concluded that the grading of mean crystal grain sizes is required and preferred to take full advantage of the permanent magnets of the present invention. The graph of FIG. 9 was based on the data obtained in a similar manner as already mentioned, provided however that the particle size of alloy powders and the crystal grain size after sintering were varied.

The permanent magnets of the present invention can be prepared with the use of commercially available materials, and it is very advantageous to use the light rare-earth elements as the key component of magnet materials. While heavy rare earth is generally of less industrial value due to the fact that it is relatively rare and expensive, it may be used alone or in combination with light rare earth.

The increase in coercive force contributes to the stabilization of magnetic properties. Hence, the addition of M makes it feasible to obtain permanent magnets, which are substantially very stable and show a high energy product. In addition, the entrainment of the elements A within the given range offers a practical advantage in view of the industrial production of permanent magnets.

As described in detail in the foregoing, the present invention provides permanent magnets comprising magnetically isotropic sintered bodies based on FeBR, FeBRM, FeBRA and FeBRMA base alloys, whereby magnetic properaties equal to, or greater than, those achieved in the prior art are realized particularly without recourse to relatively rare or expensive materials. In other words, the isotropic sintered bodies of the present invention provide practical permanent magnets, which are excellent in view of resources, prices and magnetic properties, using as R light rare earth such as Nd and Pr. Thus, the present invention is industrially of high value.

Modifications apparent in the art may be made without departing from the gist of the present invention as disclosed and claimed:

What is claimed is:

1. A powder metallurgically sintered, isotropic permanent magnet having a mean crystal grain size of 1–80 microns and consisting essentially of, by atomic percent, 12–20 percent R wherein R is at least one element selected from the group consisting of Nd, Pr, La, Ce, Tb, Dy, Ho, Er, Eu, Sm, Gd, Pm, Tm, Yb, Lu and Y and wherein at least 50% of R consists of Nd and/or Pr, 5–18 percent B and at least 62 percent Fe, in which at least 50 vol % of the entire magnet is occupied by a ferromagnetic compound having an Fe-B-R type tetragonal crystal structure, said magnet having a maximum energy product of at least 4 MGOe and an intrinsic coercivity of at least 1 kOe.

2. A powder metallurgically sintered, isotropic permanent magnet having a mean crystal grain size of 1–80 microns and consisting essentially of, by atomic percent, 12–20 percent R wherein R is at least one element selected from the group consisting of Nd, Pr, La, Ce, Tb, Dy, Ho, Er, Eu, Sm, Gd, Pm, Tm, Yb, Lu and Y and wherein at least 50% of R consists of Nd and/or Pr, 5–18 percent B, at least one additional element M selected from the group given below in the amounts not exceeding the atomic percentages specified below, wherein the sum of M does not exceed the maximum value of any one of the values specified below for M actually added and at least 62 percent Fe:

7.8% Al, 3.8% Ti, 7.8% V, 6.9% Cr, 6.9% Mn, 4.8% Zr, 4.5% Hf, 10.0% Nb, 8.8% Ta, 7.6% Mo, 5.0%

Ge, 2.0% Sb, 2.7% Sn, 4.2% Bi, 3.8% Ni, and 7.9% W, in which a ferromagnetic compound having an Fe-B-R type tetragonal crystal structure occupies at least 50 vol % of the entire magnet, said permanent magnet having a maximum energy product of at least 4 MGOe and an intrinsic coercivity of at least 1 kOe.

3. A magnet as defined in claim 1 or 2, in which R is about 15 atomic %, and B is about 8 atomic %.

4. A magnet as defined in claim 1 or 2, in which Si is present in an amount of no more than 5%.

5. A magnet as defined in claim 1 or 2, in which the sintered magnet has a mean crystal grain size of 2–30 microns.

6. The magnet as defined in claim 1 or 2, in which the sintered magnet has a mean crystal grain size of 3–20 microns.

7. A magnet as defined in claim 1 or 2, which contains 1 vol % or higher of a rare earth rich phase.

8. A magnet as defined in claim 1, in which M is one or more selected from the group consisting of V, Nb, Ta, Mo, W, Cr and Al.

9. A magnet as defined in claim 1 or 2, in which R is Nd.

10. A magnet as defined in claim 1 in which R is 12–16 atomic %, B is 6–18 atomic %, and Fe is at least 66 atomic %, and which has a maximum energy product of at least 7 MGOe.

11. A magnet as defined in claim 2, in which R is 12–16 atomic %, B is 6–18 atomic %, Fe is at least 66 atomic %, and said at least one additional element M is present in an amount not exceeding the atomic percentages specified below, wherein the sum of M does not exceed the maximum value of any one of the values specified below for M actually added:

3.4% Al, 1.3% T, 3.4% B, 1.5% Cr, 2.1% Mn, 1.9% Zr, 1.7% Hf, 2.8% Nb, 3.0% Ta, 2.8% Mo, 1.6% Ge, 0.5% Sb, 0.7% Sn, 1.9% Bi, 1.3% Ni, and 3.7% W, and which has a maximum energy product of at least 7 MGOe.

12. A magnet as defined in claim 2 or 11, in which M is present at least 0.1 atomic %.

13. A magnet as defined in claim 1 or 2, which is substantially Co-free.

* * * * *